US008110525B2

(12) United States Patent
Xiao et al.

(10) Patent No.: US 8,110,525 B2
(45) Date of Patent: Feb. 7, 2012

(54) METHOD OF PREPARING OIL ABSORBING FIBERS

(75) Inventors: Changfa Xiao, Tianjin (CN); Naiku Xu, Tianjin (CN); Shulin An, Tianjin (CN); Yan Feng, Tianjin (CN); Guangxia Jia, Tianjin (CN)

(73) Assignee: Tianjin Polytechnic University, Tianjin (CN)

( * ) Notice: Subject to any disclaimer, the term of this patent is extended or adjusted under 35 U.S.C. 154(b) by 384 days.

(21) Appl. No.: 12/541,918

(22) Filed: Aug. 15, 2009

(65) Prior Publication Data

US 2009/0306259 A1 Dec. 10, 2009

Related U.S. Application Data

(63) Continuation of application No. PCT/CN2008/072351, filed on Sep. 12, 2008.

(30) Foreign Application Priority Data

Sep. 26, 2007 (CN) ..... 2007 1 0059780

(51) Int. Cl.
*B01J 20/26* (2006.01)

(52) U.S. Cl. ..... 502/402; 524/173; 524/233; 524/558; 210/242.4

(58) Field of Classification Search ..... 502/402; 210/242.4
See application file for complete search history.

(56) References Cited

U.S. PATENT DOCUMENTS

| | | | | |
|---|---|---|---|---|
| 4,704,213 | A * | 11/1987 | Delhommer et al. | 175/72 |
| 6,770,285 | B2 * | 8/2004 | Keenan et al. | 424/401 |
| 7,192,542 | B2 * | 3/2007 | Ugazio | 264/4 |
| 7,527,738 | B2 * | 5/2009 | Gonzalez et al. | 210/690 |
| 2002/0061322 | A1 * | 5/2002 | Keenan et al. | 424/401 |

* cited by examiner

*Primary Examiner* — Charles Boyer
(74) *Attorney, Agent, or Firm* — Matthias Scholl P.C.; Matthias Scholl

(57) ABSTRACT

A method of preparing oil-absorbing fibers by: a) fully dissolving a dispersant and a deionized water in a reaction vessel, adding a methacrylate monomer and an initiator to a reactor and stirring to form a homogenous solution, transferring the homogenous solution into the reaction vessel, charging nitrogen gas, stirring, raising temperature to 70-80° C., allowing to react for 2-6 hours, raising temperature to 90-100° C., allowing to react for 2-4 hours, collecting a resultant product, washing, drying, and obtaining a white resin; b) drying the white resin, mixing with a swelling agent, and sealing the mixture at room temperature for 48-96 hours to yield a homogenous gel; c) grinding the gel completely, spinning by a plunger spinner, and coagulating with a coagulation bath to yield an as-spun oil-absorbing fiber; and d) drawing the as-spun oil-absorbing fiber with a draw ratio of 2-6 to yield oil-absorbing fibers.

17 Claims, No Drawings

METHOD OF PREPARING OIL ABSORBING FIBERS

CROSS-REFERENCE TO RELATED APPLICATIONS

This application is a continuation of International Patent Application No. PCT/CN2008/072351 with an international filing date of Sep. 12, 2008, designating the United States, now pending, and further claims priority benefits to Chinese Patent Application No. 200710059780.7 filed Sep. 26, 2007. The contents of all of the aforementioned applications, including any intervening amendments thereto, are incorporated herein by reference.

BACKGROUND OF THE INVENTION

1. Field of the Invention

The invention relates to a method, and more particularly to a method of preparing oil-absorbing fibers.

2. Description of the Related Art

In recent years, environmental pollution caused by oil from oily sewage, exhaust gas, waste liquid, and leakage of oil tankers has been increasingly serious, among which, industrial wastewater discharge accounts for 30%, and leakage of oceanic oil tankers accounts for 45%. Faced with the deteriorating environment, research on developing effective oil recovery technologies, materials for purifying oil-bearing industrial wastewater, and high quality oil absorbing materials has become a major topic.

High oil absorbing resin is a kind of self-swelling polymer having a low degree of crosslinking and consists of lipophilic monomer. The resin molecules form a three-dimensional cross-network structure in a manner of chemical, physical, and ionic crosslinking, particularly in a manner of chemical crosslinking.

In 1966, U.S. Dow Chemical Company produced a nonpolar high oil absorbing resin using alkyl vinyl as a monomer and divinylbenzene as a crosslinking agent (JP 45 27081, 1970).

In 1973, Mitsui Oil Exploration Co., Ltd., Japan produced a polar resin having a solubility of more than 9.8 g using alkyl methacrylate or alkyl styrene as a monomer and crosslinking the monomers (JP 50 15882, 1975).

In 1989, Murakami Corporation, Japan produced a polar high oil absorbing resin, namely, a copolymer of vinyl acetate and vinyl chloride, using triisopropylphenyl peroxide as a crosslinking agent (俊滕隆清), Functional Materials, 1990, 10(11): 43-49).

In 1990, Nippon Shokubai Co., Ltd. produced a medium-polar high oil absorbing resin, namely, a low crosslinked acrylic polymer having long chain alkyl at side chain thereof, using acrylic acid as a monomer (Market Data on Functional Materials, Functional Materials, 1991, 11(7): 41-47).

However, in China, researches on high oil absorbing resin are initiated late and mainly conducted by a few of universities and research institutes. Oil absorbing materials such as polynorbornene resins (Songbo, Preparation and Application of Polynorbornene, Liaoning Chemical, 1986, 6: 28-32) and polyurethane foam (Translated by Lv Hongjiu, High Oil Absorbing Polyurethane Foam, New Chemical Materials, 1994, 6: 18-22) are studied. By using methacrylic acid series as starting materials (Lu Jianmei, et al., Preparation and Properties of Oil Absorbing Complex by Microwave Radiation, Chemical World, 1999, 2: 86-89), benzoyl peroxide (BPO) (Liu Derong, et al, Preparation of Self-Swelling Oil Absorbing Resin Synthesized by Crylic Acid Series, New Chemical Materials, 1997, 4: 37-39) and persulfate (Cao Aili, et al, Preparation and Properties of Oil Absorbing Resin Synthesized by Crylic Acid Series, Polymer Materials Science & Engineering, 1999, 2: 38-40) as an initiator, and 1,4-butylene glycol diacrylate (Lu Jianmei, Zhu Xiulin, Preparation and Properties of High Oil Absorbing Resin Synthesized by Binary Copolymerization, Polymer Materials Science & Engineering, 1995, 2: 41-45), ethylene glycol diacrylate (Zhu Xiulin, et al, Preparation and Properties of High Oil Absorbing Resins, Polymer Materials Science & Engineering, 1995, 1: 19-23), and diene as a crosslinking agent (Jiang Bibiao, et al, Preparation and Properties of High Oil Absorbing Resins, China Synthetic Resin and Plastics, 1996, 2: 37-39), by method of suspension polymerization (Lu Jianmei et al, Studies on High Oil Absorbing Resins Synthesized by Methacrylate, Petrochemical, 1995, 3: 176-179), emulsion polymerization (Cao Aili, et al, Preparation and Properties of High Oil Absorbing Resins Synthesized by Crylic Acid Series, Polymer Materials Science & Engineering, 1999, 2: 38-40), or microwave radiation (Lu Jianmei, et al, Preparation and Properties of Oil Absorbing Complex Through Microwave Radiation, Chemical World, 1999, 2: 86-89), high oil absorbing resins having an oil absorbing rate of 10-30 are produced.

However, current studies on oil absorbing materials mainly focus on granular resins. Granular materials limited on its shape, have disadvantages such as slow absorbing speed and low oil absorbing rate, thereby resulting in a limited application. Nowadays there are less research reports on oil-absorbing fiber at home and abroad. China Patent Publication Number CN 1584148A (Xiao Changfa, Feng Yan, et al, Tianjin Polytechnic University) disclosed a method for preparing a polymethacrylate oil-absorbing fiber by semi-interpenetrating network technique and wet spinning. The oil-absorbing fiber has large oil absorbing area, is easy for recovery, and can be processed into various shaped products as needed. So the fiber has a wide application range, and if used in industry, it will play a positive role for treating water resources. Conventionally, in order to synthesize high oil absorbing resin, a single chemical crosslinking agent, e.g. divinylbenzene is used. Although the resultant resin has a perfect chemical crosslinking structure. It's neither soluble nor meltable, resulting in a difficulty for preparing fibers. Furthermore, in the method of preparation of oil-absorbing fibers disclosed by China Patent Publication Number CN 1584148A, polymers are synthesized step-by-step, and the obtained fibers need to be crosslinked by heat to form a chemical crosslinking structure. Therefore, the method is very complicated, and the fibers made by wet spinning have bad mechanical properties.

SUMMARY OF THE INVENTION

In view of the above-described problems, it is an objective of the invention to provide a method of preparing oil-absorbing fibers that is simple and easy for implementation and industrialization.

To achieve the above objectives, in accordance with one embodiment of the invention, there is provided a method of preparing oil-absorbing fibers that is simple and easy for implementation and industrialization, the method comprising the steps of:

a) fully dissolving a dispersant accounting for 0.1-1% of the total mass of a methacrylate monomer and a deionized water wherein the volume ratio of the deionized water to the methacrylate monomer is 3:1 in a reaction vessel. Adding the methacrylate monomer and an initiator accounting for 0.1-1% of the total mass of the methacrylate monomer to a reactor and stirring to form a homogenous solution, transferring the homogenous solution into the reaction vessel, charging nitrogen gas, stirring, raising temperature to 70-80° C., allowing to react for 2-6 hours, raising temperature to 90-100° C., allowing to react for 2-4 hours, collecting a resultant product, washing, drying, and obtaining a white resin, the methacrylate monomer comprising n-butyl methacrylate as a first monomer and hydroxyethyl methacrylate as a second monomer, n-butyl methacrylate accounting for 80-95% of the total mass of the methacrylate monomer, and hydroxyethyl methacrylate accounting for 5-20% of the total mass of the methacrylate monomer;

b) drying the white resin, mixing with a swelling agent, and sealing the mixture at room temperature for 48-96 hours to yield a homogenous gel;

c) grinding the gel completely, spinning by a plunger spinner, and coagulating with a coagulation bath to yield an as-spun oil-absorbing fiber. The spinning temperature being 90-200° C. and the coagulating temperature being 25-50° C.; and d) drawing the as-spun oil-absorbing fiber with a draw ratio of 2-6 at 25-80° C. to yield oil-absorbing fibers.

In a class of this embodiment, the dispersant is polyvinyl alcohol, methyl cellulose, polyethylene glycol, soluble starch, or gelatin.

In a class of this embodiment, the initiator is benzoyl peroxide or azodiisobutyronitrile.

In a class of this embodiment, the swelling agent is dimethylformamide, dimethyl sulfoxide, or dimethyl acetamide, and the amount thereof is ⅙-4 times that of the white resin.

In a class of this embodiment, the coagulation bath is a mixture of distilled water and the swelling agent, and the amount of the swelling agent is 5-40% by volume.

In a class of this embodiment, the methacrylate monomer further comprises a third monomer.

In a class of this embodiment, the third monomer is lauryl methacrylate, tetradecyl methacrylate, hexadecyl methacrylate, or octadecyl methacrylate.

In a class of this embodiment, the amount of the third monomer is the same as that of the second monomer. The total amount of the second monomer and the third monomer accounts for 5-20% of the total mass of the methacrylate monomer.

In a class of this embodiment, the dispersant is polyvinyl alcohol.

In a class of this embodiment, the initiator is benzoyl peroxide.

In a class of this embodiment, the swelling agent is dimethylformamide.

In a class of this embodiment, the draw ratio is 3-5.

In a class of this embodiment, the third monomer is lauryl methacrylate or octadecyl methacrylate.

Advantages of the invention are summarized as follows:

1) the method is simple, easy for implementation and industrialization, and have a short production cycle;

2) the fiber prepared by the method only needs simple post-processing and has good mechanical properties; and 3) the fiber has a three-dimensional network structure and good oil absorbing capability, and is difficult to dissolve in oily products. For example, for a fiber comprising 85% n-butyl methacrylate and 15% hydroxyethyl methacrylate, the maximum oil absorbency capability is 12.03 g toluene/g fiber and 22.91 g trichloroethylene/g fiber. The fiber has a large specific surface area and high absorbing efficiency, and can be processed into various fiber products by conventional weaving methods or non-woven processing.

DETAILED DESCRIPTION OF THE EMBODIMENTS

In one embodiment of the invention, provided is a method of preparing oil-absorbing fibers that is simple and easy for implementation and industrialization, the method comprising the steps of:

a) fully dissolving a dispersant accounting for 0.1-1% of the total mass of a methacrylate monomer and a deionized water wherein the volume ratio of the deionized water to the methacrylate monomer is 3:1 in a reaction vessel, adding the methacrylate monomer and an initiator accounting for 0.1-1% of the total mass of the methacrylate monomer to a reactor and stirring to form a homogenous solution, transferring the homogenous solution into the reaction vessel, charging nitrogen gas, stirring, raising temperature to 70-80° C., allowing to react for 2-6 hours, raising temperature to 90-100° C., allowing to react for 2-4 hours, collecting a resultant product, washing, drying, and obtaining a white resin, the methacrylate monomer comprising n-butyl methacrylate as a first monomer and hydroxyethyl methacrylate as a second monomer, n-butyl methacrylate accounting for 80-95% of the total mass of the methacrylate monomer, hydroxyethyl methacrylate accounting for 5-20% of the total mass of the methacrylate monomer, the dispersant being polyvinyl alcohol, methyl cellulose, polyethylene glycol, soluble starch, or gelatin, and the initiator being benzoyl peroxide or azodiisobutyronitrile;

b) drying the white resin, mixing with a swelling agent, and sealing the mixture at room temperature for 48-96 hours to yield a homogenous gel, the swelling agent being dimethylformamide, dimethyl sulfoxide, or dimethyl acetamide, and the amount thereof being ⅙-4 times that of the white resin;

c) grinding the gel completely, spinning by a plunger spinner, and coagulating with a coagulation bath to yield an as-spun oil-absorbing fiber, the spinning temperature being 90-200° C., the coagulation bath being a mixture of distilled water and the swelling agent, the amount of the swelling agent being 5-40% by volume, and the coagulating temperature being 25-50° C.; and d) drawing the as-spun oil-absorbing fiber with a draw ratio of 2-6 at 25-80° C. to yield oil-absorbing fibers.

The methacrylate monomer of the invention comprises the first monomer and the second monomer, and optionally comprises a third monomer. The first monomer is n-butyl methacrylate, and the second monomer is hydroxyethyl methacrylate. The third monomer is lauryl methacrylate, tetradecyl methacrylate, hexadecyl methacrylate, or octadecyl methacrylate. As the first monomer, n-butyl methacrylate accounts for 80-95% of the total mass of the methacrylate monomer. As the second monomer, hydroxyethyl methacrylate accounts for 5-20% of the total mass of the methacrylate monomer. When the third monomer is added, the amount thereof is the same as that of the second monomer, and the total amount of the two monomers accounts for 5-20% of the total mass of the methacrylate monomer.

Preferably, the first monomer is n-butyl methacrylate, the second monomer is hydroxyethyl methacrylate, and the third monomer is lauryl methacrylate or octadecyl methacrylate.

The monomers used in the invention are methacrylate series. The polymer molecules generated by these monomers have lipophilic groups (ester group) and exhibit affinity to a variety of oily products, so they can absorb a large amount of oil. Additionally, after addition of the second and the third monomer, the fiber has a certain degree of crosslinking and crosslinking density, which makes the fiber swell and difficult to dissolve upon absorbing oil, and thereby increasing the oil absorbing capability of the fiber.

The selection of the second and the third monomer is based on the following principles: 1) the second and the third monomer should be easily polymerized with n-butyl methacrylate; 2) the second and the third monomer should have a hydrogen donating group and a hydrogen receiving group for hydrogen bond formation, and have a long side chain for molecular entanglement; 3) the resultant copolymer should meet the requirement for gel spinning; 4) the second and the third monomer should have a lipophilic group by its own so that the fiber can improve the oil absorbing selectivity and absorbing capability; and 5) the second and the third monomer should cause neither physical nor chemical damage on the final fiber.

Accordingly, hydroxyethyl methacrylate having hydrogen donating group and hydrogen receiving group by its own is selected as the second monomer of the invention, and lauryl methacrylate or octadecyl methacrylate having a long side chain for molecular entanglement is selected as the third monomer of the invention.

In the invention, the initiator is benzoyl peroxide or azodiisobutyronitrile, particularly benzoyl peroxide. Due to the influence of the type and amount of the initiator on polymerization rate and polymerization degree, the selection of the initiator is very important. Generally, radical suspension polymerization is conducted at 40-100° C., so the selected initiator should exhibit good activity at the temperature range. The activity of an initiator is usually representative by half life thereof (the time required for the initiator to fall to half its initial concentration). If half life of the initiator is too short, a large amount of free radicals will be produced in a short time, which may cause explosive polymerization and make polymerization lose control, and at the late stage of polymerization, due to insufficient initiator, the polymerization will become very slow, even result in dead-end polymerization. On the contrary, if half life of the initiator is too long, the degradation of the initiator is very slow, which will lead to a very slow initial polymerization, a sharp gel effect at late stage, and even lose control on the reaction; furthermore, undegraded initiator residues remain in the polymer product, not only causing waste but also affecting the quality of the product.

In the invention, the polymerization temperature of methacrylate is 75-85° C., and benzoyl peroxide exhibits good activity under the temperature range, so benzoyl peroxide is preferable for polymerization.

In the invention, the dispersant is polyvinyl alcohol, methyl cellulose, polyethylene glycol, soluble starch, or gelatin, particularly polyvinyl alcohol. In a suspension polymerization system, water phase (comprising water and dispersant) is a main factor affecting particle formation mechanism and particle characteristics, makes monomers dispersed into droplets, and performs the functions as a heat transfer medium. The role of the dispersant is: first, to reduce the surface tension and make monomers dispersed into a single droplet; second, to prevent particles from coagulating due to that when the polymerization is carried out to a certain conversion rate (such as 20-30%), the monomer is converted into polymers/monomer solution particles which tends to coagulate, but the dispersant adhered on the particle surface prevents the occurrence of coagulating.

Generally, the selection of the dispersant is based on the dispersibility and colloid protection ability thereof. Studies have shown the dispersibility and colloid protection ability of polyethylene glycol and soluble starch is bad, methyl cellulose has bad water solubility, and polyvinyl alcohol and gelatin have good comprehensive properties. Comparatively, polyvinyl alcohol is cheap, so it is a preferable dispersant of the invention.

In the invention, the oil-absorbing fiber is prepared by gel spinning, the principle of which is summarized below: without a chemical crosslinking agent, a physical crosslinking structure is formed in the copolymer polymerized by the second monomers or by the second monomers and the third monomers. The formation of the physical crosslinking structure is attributed to the hydrogen bond and molecular entanglement of the second monomers or the second and the third monomers. By controlling the amount of the added second and third monomers, the copolymer having the physical crosslinking structure can meet the requirement for gel spinning due to its swelling, difficulty for dissolving, and melting by heating (swollen in swelling agents). The swelling agent of the invention is dimethylformamide, dimethyl sulfoxide, or dimethyl acetamide, particularly dimethylformamide, and the amount thereof is ⅓-4 times that of the white resin. The gel spinning is covered by prior art.

The fibers of the invention have high saturation oil-adsorbing capacity and oil retention. Although the first monomer can be used singly, the obtained fibers are not ideal. The network structure (e.g., the crosslinking degree and crosslinking density) of the fibers subjects to the amount of the second monomer or the second monomer and the third monomer. If the content of the second monomer or the second monomer and the third monomer is too low, the physical crosslinking structure is not good, which will cause the fibers to dissolve in oily products. If the content of the second monomer or the second monomer and the third monomer is too high, the physical crosslinking structure will be too compact, which is, on the one hand, not conductive for gel spinning due to high spinning temperature, on the other hand, not conductive for the diffusion of oily products in the fibers, and reduce the saturation oil-adsorbing capacity of the fibers. If the amount of the second monomer or the second monomer and the third monomer is appropriate, the crosslinking degree and crosslinking density of the fibers will be perfect, and thereby the fibers can fully absorb oil but not dissolve, a high saturation oil-adsorbing capacity is achieved.

The as-spun oil-absorbing fibers from the coagulation bath of the invention further need drawing, winding, and after-drawing. Appropriate after-drawing improves the mechanical properties of the fibers and is conductive to further processing of fibers. The after-drawing ratio should be appropriate, if too low, the effect will be bad; if too high, the fibers may be broken. A common drawing ratio is 2-6, particularly 3-5.

For further illustrating the invention, some examples are given below. It should be noted that the following are intended to describe only and not to limit the invention.

Example 1

Take n-butyl methacrylate as a first monomer, hydroxyethyl methacrylate as a second monomer, the mass ratio of the second monomer to the first monomer being 3:17, benzoyl peroxide as an initiator, polyvinyl alcohol as a dispersant, and distilled water as a reaction medium. In the presence of nitrogen gas, the initiator (accounting for 0.5% of the total mass of the monomers) and the monomers were added to a mixture prepared by dissolving the dispersant (accounting for 0.5% of the total mass of the monomers) in water. The solution was heated to 75° C., stirred for 4 hours, and then heated to 85° C. and allowed to react for 2 hours. The resultant product was collected, washed, and dried to yield a white granular resin. The resin was dried completely, mixed with a swelling agent dimethylformamide (the mass ratio of the resin to the swelling agent is 3:2), and sealed at room temperature for 48 hours to yield a homogenous gel. The gel was ground, spun by gel spinning, and coagulated in a coagulation bath (water) to yield an as-spun oil-absorbing fiber. The spinning temperature is 160° C. As for the oil absorbing performance, the fiber can be directly used without post processing.

The obtained as-spun oil-absorbing fiber was dried completely under room temperature, and immersed in toluene and trichloroethylene respectively, the measured saturation oil adsorbing capacity is 12.03 and 22.91 ($g \cdot g^{-1}$) respectively. The saturated gel was centrifugated for 5 minutes at 1000 r/min, and the measured oil retention is 73.6% and 46.03% respectively.

Example 2

Take n-butyl methacrylate as a first monomer, hydroxyethyl methacrylate as a second monomer, the mass ratio of the second monomer to the first monomer being 1:9, benzoyl peroxide as an initiator, polyvinyl alcohol as a dispersant, and distilled water as a reaction medium. In the presence of nitrogen gas, the initiator (accounting for 0.5% of the total mass of the monomers) and the monomers were added to a mixture prepared by dissolving the dispersant (accounting for 0.5% of the total mass of the monomers) in water. The solution was heated to 75° C., stirred for 4 hours, and then heated to 85° C. and allowed to react for 2 hours. The resultant product was collected, washed, and dried to yield a white granular resin. The resin was dried completely, mixed with a swelling agent dimethylformamide (the mass ratio of the resin to dimethylformamide is 3:2), and sealed at room temperature for 48 hours to yield a homogenous gel. The gel was ground, spun by gel spinning, and coagulated in a coagulation bath (water) to yield an as-spun oil-absorbing fiber. The spinning temperature is 150° C.

The obtained as-spun oil-absorbing fiber was dried under room temperature, and immersed in toluene and trichloroethylene respectively, the measured saturation oil adsorbing capacity is 11.21 and 17.88 ($g \cdot g^{-1}$) respectively. The saturated gel was centrifugated for 5 minutes at 1000 r/min, and the measured oil retention is 22.62% and 44.7% respectively.

Example 3

Take n-butyl methacrylate as a first monomer, hydroxyethyl methacrylate as a second monomer, the mass ratio of the second monomer to the first monomer being 1:19, benzoyl peroxide as an initiator, polyvinyl alcohol as a dispersant, and distilled water as a reaction medium. In the presence of nitrogen gas, the initiator (accounting for 0.5% of the total mass of the monomers) and the monomers were added to a mixture prepared by dissolving the dispersant (accounting for 0.5% of the total mass of the monomers) in water. The solution was heated to 75° C., stirred for 4 hours, and then heated to 85° C. and allowed to react for 2 hours. The resultant product was collected, washed, and dried to yield a white granular resin. The resin was dried completely, mixed with a swelling agent dimethylformamide (the mass ratio of the resin to dimethylformamide is 7:3), and sealed at room temperature for 48 hours to yield a homogenous gel. The gel was ground, spun by gel spinning, and coagulated in a coagulation bath (water) to yield an as-spun oil-absorbing fiber. The spinning temperature is 140° C.

The obtained as-spun oil-absorbing fiber was dried under room temperature, and immersed in toluene and trichloroethylene respectively, the measured saturation oil-adsorbing capacity is 7.81 and 12.95 ($g \cdot g^{-1}$) respectively. The saturated gel was centrifugated for 5 minutes at 1000 r/min, and the measured oil retention is 8.18% and 34.91% respectively.

Example 4

Take n-butyl methacrylate as a first monomer, hydroxyethyl methacrylate as a second monomer, lauryl methacrylate as a third monomer, the mass ratio of the second monomer to the first monomer being 1:19, the mass ratio of the second monomer to the third monomer being 1:1, benzoyl peroxide as an initiator, polyvinyl alcohol as a dispersant, and distilled water as a reaction medium. In the presence of nitrogen gas, the initiator (accounting for 0.5% of the total mass of the monomers) and the monomers were added to a mixture prepared by dissolving the dispersant (accounting for 0.5% of the total mass of the monomers) in water. The solution was heated to 75° C., stirred for 4 hours, heated to 85° C. and allowed to react for 2 hours, and further heated to 95° C. and allowed to react for 2 hours. The resultant product was collected, washed, and dried to yield a white granular resin. The resin was dried completely, mixed with a swelling agent dimethylformamide (the mass ratio of the resin to dimethylformamide is 7:3), and sealed at room temperature for 48 hours to yield a homogenous gel. The gel was ground, spun by gel spinning, and coagulated in a coagulation bath (water) to yield an as-spun oil-absorbing fiber. The spinning temperature is 140° C.

The obtained as-spun oil-absorbing fiber was dried under room temperature, and immersed in toluene and trichloroethylene respectively, the measured saturation oil-adsorbing capacity is 7.11 and 11.95 ($g \cdot g^{-1}$) respectively. The saturated gel was centrifugated for 5 minutes at 1000 r/min, and the measured oil retention is 7.05% and 31.72% respectively.

Example 5

Take n-butyl methacrylate as a monomer, benzoyl peroxide as an initiator, polyvinyl alcohol as a dispersant, and distilled water as a reaction medium. In the presence of nitrogen gas, the initiator (accounting for 0.5% of the total mass of the monomers) and the monomers were added to a mixture prepared by dissolving the dispersant (accounting for 0.5% of the total mass of the monomers) in water. The solution was heated to 75° C., stirred for 4 hours, and then heated to 85° C. and allowed to react for 2 hours. The resultant product was collected, washed, and dried to yield a white granular resin. The resin was dried completely, mixed with a swelling agent dimethylformamide (the mass ratio of the resin to dimethylformamide is 7:3), and sealed at room temperature for 48 hours to yield a homogenous gel. The gel was ground, spun by gel spinning, and coagulated in a coagulation bath (water) to yield an as-spun oil-absorbing fiber. The spinning temperature is 120° C.

The obtained as-spun oil-absorbing fiber was dried under room temperature, and immersed in toluene and trichloroethylene respectively. Since no second monomer was added, no crosslinking structure was formed in the resin, and thereby the fibers showed a linear structure and were dissolved in oily products completely.

Example 6

Take n-butyl methacrylate as a first monomer, lauryl methacrylate as a second monomer, the mass ratio of the second monomer to the first monomer being 3:17, benzoyl peroxide as an initiator, polyvinyl alcohol as a dispersant, and distilled water as a reaction medium. In the presence of nitrogen gas, the initiator (accounting for 0.5% of the total mass of the monomers) and the monomers were added to a mixture prepared by dissolving the dispersant (accounting for 0.5% of the total mass of the monomers) in water. The solution was heated to 75° C., stirred for 4 hours, heated to 85° C. and allowed to react for 2 hours, and further heated to 95° C. and allowed to react for 2 hours. The resultant product was collected, washed, and dried to yield a white granular resin. The resin was dried completely, mixed with a swelling agent dimethylformamide (the mass ratio of the resin to dimethylformamide is 7:3), and sealed at room temperature for 48 hours to yield a homogenous gel. The gel was ground, spun by gel spinning, and coagulated in a coagulation bath (water) to yield an as-spun oil-absorbing fiber. The spinning temperature is 120° C.

The obtained as-spun oil-absorbing fiber was dried under room temperature, and immersed in toluene and trichloroethylene respectively. Since no hydroxyethyl methacrylate was added, no hydrogen bond was introduced in the resin, and thereby the fibers showed a linear structure and were dissolved in oily products completely.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

The invention claimed is:

1. A method of preparing an oil-absorbing fiber comprising the steps of:

a) fully dissolving a dispersant accounting for 0.1-1% of the total mass of a methacrylate monomer and a deionized water wherein the volume ratio of said deionized water to said methacrylate monomer is 3:1 in a reaction vessel, adding said methacrylate monomer and an initiator accounting for 0.1-1% of the total mass of said methacrylate monomer to a reactor and stirring to form a homogenous solution, transferring said homogenous solution into said reaction vessel, charging nitrogen gas, stirring, raising temperature to 70-80° C., allowing to react for 2-6 hours, raising temperature to 90-100° C., allowing to react for 2-4 hours, collecting a resultant product, washing, drying, and obtaining a white resin, said methacrylate monomer comprising n-butyl methacrylate as a first monomer and hydroxyethyl methacrylate as a second monomer, n-butyl methacrylate accounting for 80-95% of the total mass of said methacrylate monomer, and hydroxyethyl methacrylate accounting for 5-20% of the total mass of said methacrylate monomer;

b) drying said white resin, mixing with a swelling agent, and sealing the mixture at room temperature for 48-96 hours to yield a homogenous gel;

c) grinding said gel completely, spinning by a plunger spinner, and coagulating with a coagulation bath to yield an as-spun oil-absorbing fiber; the spinning temperature being 90-200° C. and the coagulating temperature being 25-50° C.; and d) drawing said as-spun oil-absorbing fiber with a draw ratio of 2-6 at 25-80° C. to yield oil-absorbing fibers.

2. The method of claim 1, wherein said dispersant is polyvinyl alcohol, methyl cellulose, polyethylene glycol, soluble starch, or gelatin.

3. The method of claim 1, wherein said initiator is benzoyl peroxide or azodiisobutyronitrile.

4. The method of claim 1, wherein said swelling agent is dimethylformamide, dimethyl sulfoxide, or dimethyl acetamide, and the amount thereof is ⅙-4 times that of said white resin.

5. The method of claim 1, wherein said coagulation bath is a mixture of distilled water and said swelling agent, and the amount of said swelling agent is 5-40% by volume.

6. The method of claim 1, wherein said methacrylate monomer further comprises a third monomer.

7. The method of claim 6, wherein said third monomer is lauryl methacrylate, tetradecyl methacrylate, hexadecyl methacrylate, or octadecyl methacrylate.

8. The method of claim 6, wherein the amount of said third monomer is the same as that of said second monomer, and the total amount of said second monomer and said third monomer accounts for 5-20% of the total mass of the methacrylate monomer.

9. The method of claim 1, wherein said dispersant is polyvinyl alcohol.

10. The method of claim 1, wherein said initiator is benzoyl peroxide.

11. The method of claim 1, wherein said swelling agent is dimethylformamide.

12. The method of claim 1, wherein said draw ratio is 3-5.

13. The method of claim 6, wherein said third monomer is lauryl methacrylate or octadecyl methacrylate.

14. The method of claim 6, wherein said dispersant is polyvinyl alcohol.

15. The method of claim 6, wherein said initiator is benzoyl peroxide.

16. The method of claim 6, wherein said swelling agent is dimethylformamide.

17. The method of claim 6, wherein said draw ratio is 3-5.

* * * * *